US010724300B2

(12) United States Patent
Gao et al.

(10) Patent No.: US 10,724,300 B2
(45) Date of Patent: Jul. 28, 2020

(54) DOWNHOLE DRILLING TOOL SYSTEM OF TORQUE SELF-BALANCING

(71) Applicant: Jilin University, Jilin (CN)

(72) Inventors: Ke Gao, Changchun (CN); Youhong Sun, Changchun (CN); Zhigang Wang, Changchun (CN); Yan Zhao, Changchun (CN); Kun Bo, Changchun (CN); Xiaobo Xie, Changchun (CN); Haiyong Wang, Changchun (CN); Xiaochu Wang, Changchun (CN); Zhao Liu, Changchun (CN); Yafei Wang, Changchun (CN); Hangkai Chen, Changchun (CN); Saiyu Peng, Changchun (CN); Yingchao Xu, Changchun (CN); Lidong Xing, Changchun (CN)

(73) Assignee: Jilin University, Changchun, Jilin Province (CN)

( * ) Notice: Subject to any disclaimer, the term of this patent is extended or adjusted under 35 U.S.C. 154(b) by 107 days.

(21) Appl. No.: 15/898,324

(22) Filed: Feb. 16, 2018

(65) Prior Publication Data

US 2019/0063157 A1 Feb. 28, 2019

(51) Int. Cl.
*E21B 7/00* (2006.01)
*E21B 10/04* (2006.01)
(Continued)

(52) U.S. Cl.
CPC ..... *E21B 7/00* (2013.01); *E21B 4/003* (2013.01); *E21B 4/04* (2013.01); *E21B 10/04* (2013.01);
(Continued)

(58) Field of Classification Search
CPC ... E21B 7/00; E21B 25/00; E21B 4/04; E21B 4/003; E21B 21/08; E21B 47/00; E21B 10/04; E21B 21/12; E21B 19/084
See application file for complete search history.

(56) References Cited

U.S. PATENT DOCUMENTS 3,181,631 A * 5/1965 Nielsen ..... E21B 4/04 175/96

* cited by examiner

*Primary Examiner* — Brad Harcourt
(74) *Attorney, Agent, or Firm* — David A. Boag; Boag Law, PLLC

(57) ABSTRACT

The present invention relates to a downhole drilling tool system of torque self-balancing and belongs to a technical field of drilling engineering equipment. The drilling tool system consists of an assembly of internal and external drill bits, power components, a pressure adjustment system for internal and external drill bits, a mud circulating system, and an unfreezing system. The present invention employs a dual drill bit of internal and external drill bits to crush rocks by inverse rotations, which realizes the drilling with slight disturbing to the surrounding rock; the torque self-balancing of the drill bit and the power system is realized as a whole without the torque effect to the upper drilling tool by utilizing the stator group and the rotor group of the power motor to drive the external and internal drill bits respectively; it is only necessary to trip the winch apparatus for the drilling tool on the ground to realize the normal operations of drilling, tripping, and logging-while-drilling by integrating the power source, mud circulating system and logging system, etc. into the drilling tool; the winch hoists up the drilling tool to remove rock particles at the sticking point by alternative positive and reverse rotations of the drill bit for unfreezing in order to realize the unfreezing when got stuck.

2 Claims, 8 Drawing Sheets

(51) Int. Cl.

| | |
|---|---|
| ***E21B 47/00*** | (2012.01) |
| ***E21B 21/08*** | (2006.01) |
| ***E21B 4/00*** | (2006.01) |
| ***E21B 4/04*** | (2006.01) |
| ***E21B 25/00*** | (2006.01) |

(52) U.S. Cl.
CPC ..... *E21B 21/08* (2013.01); *E21B 25/00* (2013.01); *E21B 47/00* (2013.01)

DOWNHOLE DRILLING TOOL SYSTEM OF TORQUE SELF-BALANCING

TECHNICAL FIELD

The present invention belongs to a technical field of drilling engineering equipment, in particular relates to a downhole drilling tool system of torque self-balancing applicable to the fields of geological drilling, hydrological borehole drilling, oil and gas drilling, scientific drilling, ocean drilling and rescue drilling in underground buildings, etc.

BACKGROUND

In the process of borehole drilling, a drill string is deformed into a helix form under the effect of torque, and then collides and rubs against the wall of borehole during rotation, in which the drill string readily tends to be damaged prematurely under the action of wear and alternating load, thereby leading to accidents such as rapture of the drilling tool, etc. within the borehole, which brings a great loss to the whole project. With the drilling depth increased, the length of the drill string increases, and the rate of energy consumed by the drill string against various frictional resistances within the borehole increases in the process of transmitting drilling pressure and torque, therefore drill rig is required to provide a greater torque. When the borehole depth reaches a certain value, it is necessary to add downhole power tools in proximity to the drill bit in order to provide torque for the high speed rotation of the bit, and an upper drill string provides a reverse torque for the bit by a slow rotation of a ground rotary table (TDS). Obviously, although the reverse torque generated by the rock-crushing, which is by means of the rotation of the drill tool within the borehole, may endanger the whole drill string and the ground apparatus, the drilling process needs to first satisfy the environment condition of reverse torque in order to be implemented smoothly. Meanwhile, an individual drill bit requires surrounding rocks to provide the corresponding reverse torque for the rock in contact with the bit while the rock is being crushed, thereby there exists a higher requirement for surrounding rocks of the borehole wall. In case of drilling a crushed stratum, the surrounding rocks cannot provide a sufficient reverse torque by an inherent binding force for the rock in contact with the drill bit, and thereby break away from the borehole wall in a form of block structures. In addition, the borehole wall is stirred by a local turbulence generated by the mud circulated due to rotation of the drill string, and the borehole may be enlarged. When drilling through the hard large granular glutenite, the slipping gravel can easily enter the water gap of borehole and produce great torque with other gravel bridges, which will easily lead to the caving of drill bit teeth. The stability of the borehole wall is crucial for a smooth implementation of the borehole drilling, and the stability of the borehole wall is bound up with the disturbing degree to the borehole wall by the subjective drilling tool besides depending on the integrity of the objective stratum and the lithologic character. For this reason, domestic and foreign experts have tried every means to reduce disturbing to the borehole wall caused by the drill string. In addition, for the purpose of driving the bit to drill by crushing the rocks, a large and costly ground drilling apparatus should be equipped together with matched complex drilling tools and process with huge investment, in which the energy used for crushing rocks only accounts for about 10% of the total energy consumed by the drilling system, and a majority of the energy is used for operation of the apparatus.

Until now there have been few researches on the torque balanced drilling tool system at home and aboard. The scientific research is mostly directed to improve the drilling efficiency as far as possible in terms of structure, material, and process to save the drilling cost, which is based on the traditional drilling tool system, and some relating theoretical results have been achieved. In terms of the reduction of the disturbing to the borehole wall from the drill string, etc., the Brown Petroleum Tools Company in US manufactured the first set of the prototype of workover rig with coiled tubing in the 1960s, in which the power drilling tools are disposed at a position near the drill bit within the borehole. The coiled tubing only provides the reverse torque and the power source of the mud but with no rotation, which significantly reduces the disturbing to the borehole wall. The drill rig with coiled tubing was applied to the drilling from 1990s, and until 2011, the total number of drill rigs with coiled tubing around the world exceeded 1881. The application fields of the coiled-tubing drilling technology almost cover every aspect of small-diameter drilling boreholes. There are oversea companies such as Foremost Company, Baker Hughes Company and Shell Company, etc. And most of the domestic companies mainly aim to absorb imported technologies. At present, the companies who devote the research on coiled-tubing drilling technology include Honghua Petroleum Equipment co., LTD of Sichuan, Han River machinery research institute of CNPC, Great Wall Drilling Engineering co., LTD, Drilling Engineering Institute of Technology of CNPC and so on. However, since the coiled-tubing drilling technology fails to eliminate radically the harmful effects to the coiled tubing caused by the reverse torque, the working life of the coiled tubing is shorter than that of a conventional drill string.

Therefore, a new technique is needed to solve this problem.

SUMMARY

In view of the problems and drawbacks described in the background, the object of the present invention is to propose a downhole drilling tool system of torque self-balancing, which radically inhibits the harm of reverse torque caused by the rotational drilling of the drill string, changes the disturbing intensity to the surrounding rock from the one-way rock-crushing made by the drill bit, and simplifies the ground drilling apparatus and the matched tools and process, thereby realizing the objects such as reducing accidents within the borehole, lowering drilling cost, decreasing energy consumption and improving drilling efficiency.

To achieve the above-mentioned objects, the present invention proposes technical solutions as follows.

a downhole drilling tool system of torque self-balancing, characterized in that the drilling tool system consists of an assembly of internal and external drill bits, power components, a pressure adjustment system for internal and external drill bits, a mud circulating system, and an unfreezing system.

wherein the assembly of internal and external drill bits comprises an internal drill bit, an external drill bit, a core barrel, a lower force-transfer joint of external drill bit, an upper force-transfer joint of external drill bit, a seal for internal and external drill bits I, a seal for internal and external drill bits II, a lower force-transfer joint of internal drill bit, an upper force-transfer joint of internal drill bit and a torque-transfer string of internal drill bit; the internal drill bit, the core barrel, the lower force-transfer joint of internal drill bit, the upper force-transfer joint of internal drill bit and the torque-transfer string of internal drill bit are threadedly connected in sequence, and an inner diameter of the core barrel is matched with an inner diameter of the internal drill bit; the external drill bit, the lower force-transfer joint of external drill bit and the upper force-transfer joint of external drill bit are threadedly connected in sequence; the seal for internal and external drill bits I and the seal for internal and external drill bits II form a pair of sliding seals for internal and external drill bits which is located between the upper force-transfer joint of external drill bit and the lower force-transfer joint of internal drill bit and is fitted closely and slidably with both the upper force-transfer joint of external drill bit and the lower force-transfer joint of internal drill bit;

wherein the power components comprise a rotor group of power motor, a seal ring of bearing for power system, a lower seal for power system, a bearing for power system, a stator group of power motor and an upper seal for power system; the rotor group of power motor and the stator group of power motor are connected with the bearing for power system respectively, wherein an inner hole of the rotor group of power motor is provided with keyways via which the rotor group of power motor is connected with the torque-transfer string of internal drill bit; the stator group of power motor, the lower seal for power system, the upper force-transfer joint of external drill bit and the lower force-transfer joint of external drill bit are threadedly connected in sequence; the lower seal for power system is threadedly connected with the upper force-transfer joint of external drill bit, and the lower seal for power system cooperates with the seal ring of bearing for power system to form a lower closed cavity; the upper seal for power system is threadedly connected with a pressure-transfer joint of external drill bit, and the upper seal for power system cooperates with the seal ring of bearing for power system to form an upper closed cavity;

wherein the pressure adjustment system for internal and external drill bits is communicatively connected with a data terminal on the ground via data cables, the pressure adjustment system for internal and external drill bits comprises two assemblies, namely a pressure adjustment assembly for internal drill bit and a pressure adjustment assembly for external drill bit, and the pressure adjustment assembly for internal drill bit and the pressure adjustment assembly for external drill bit are threadedly connected by a centralizing sleeve for pressure adjustment; the pressure adjustment assembly for internal drill bit consists of a pressure-transfer joint of internal drill bit, an outer anti-off sleeve for pressure-transfer mechanism of internal drill bit, a pressure-transfer and no-torque-transfer bearing for internal drill bit, a pressure sensor for internal drill bit, a force-transfer centralizer of internal drill bit for pressure adjustment and a pressure adjustment structure; the pressure adjustment structure, the force-transfer centralizer of internal drill bit for pressure adjustment, the pressure sensor for internal drill bit, the pressure-transfer joint of internal drill bit and the outer anti-off sleeve for pressure-transfer mechanism of internal drill bit are threadedly connected in sequence from top to down; an inner ring of the pressure-transfer and no-torque-transfer bearing for internal drill bit is connected with the pressure-transfer joint of internal drill bit, and an outer ring of the pressure-transfer and no-torque-transfer bearing for internal drill bit is connected with the outer anti-off sleeve for pressure-transfer mechanism of internal drill bit; the pressure adjustment assembly for external drill bit consists of a pressure-transfer joint of external drill bit, an outer anti-off sleeve for pressure-transfer mechanism of external drill bit, a pressure-transfer and no-torque-transfer bearing for external drill bit, a pressure-transfer string for external drill bit, a pressure sensor for external drill bit and a pressure adjustment housing; the pressure adjustment housing, the pressure sensor for external drill bit, the pressure-transfer string for external drill bit, the outer anti-off sleeve for pressure-transfer mechanism of external drill bit and the pressure-transfer joint of external drill bit are threadedly connected in sequence from top to down, wherein the pressure adjustment housing is threadedly connected with an upper joint of mud circulating system; an inner ring of the pressure-transfer and no-torque-transfer bearing for external drill bit is connected with the pressure-transfer joint of external drill bit and an outer ring of the pressure-transfer and no-torque-transfer bearing for external drill bit is connected with the pressure-transfer string for external drill bit; the seal ring for internal and external sensors is disposed between the pressure sensor for internal drill bit and the pressure sensor for external drill bit; the power pressure-transfer seal ring for internal drill bit is located between a force-transfer centralizer of internal drill bit for adjustment and the pressure sensor for internal drill bit; a sealing gland for pressure adjustment is situated between the pressure adjustment housing and the pressure sensor for external drill bit;

wherein the mud circulating system comprises a lower joint of mud circulating system, a mud circulating system, a housing for mud circulating system and an upper joint of mud circulating system; the lower joint of mud circulating system, the housing for mud circulating system and the upper joint of mud circulating system are threadedly connected in sequence, wherein the lower joint of mud circulating system is threadedly connected with the pressure adjustment housing, and the upper joint of mud circulating system is threadedly connected with a lower joint of unfreezing system; the mud circulating system is situated between the lower joint of mud circulating system and the upper joint of mud circulating system; the seal ring for circulating system is disposed between the lower joint of mud circulating system and the mud circulating system;

wherein the unfreezing system comprises a lower joint of unfreezing system, a logging-while-drilling system, a rotor joint of unfreezing system, a lower seal for unfreezing system, seal rings for unfreezing system, a centralizing bearing for unfreezing system, a rotor group of unfreezing system, a stator group of unfreezing system, an upper seal for unfreezing system, a drill bit for unfreezing system, a cable with sheath and a center tube for mud circulation; the lower joint of unfreezing system, the logging-while-drilling system, the rotor joint of unfreezing system and the rotor group of unfreezing system are threadedly connected in sequence; the lower seal for unfreezing system, the stator group of unfreezing system, the upper seal for unfreezing system and the drill bit for unfreezing system are threadedly connected in sequence; the rotor joint of unfreezing system is fitted with the lower seal for unfreezing system with a clearance; the rotor group of unfreezing system and the stator group of unfreezing system are connected with the centralizing bearing for unfreezing system respectively; a seal ring for unfreezing system is arranged between the rotor group of unfreezing system and the lower seal for unfreezing system, and a seal ring for unfreezing system is also arranged between the rotor group of unfreezing system and the upper seal for unfreezing system; the cable with sheath and the center tube for mud circulation are in a sealed and threaded connection with the upper seal for unfreezing system, respectively.

Furthermore, the logging-while-drilling system is provided with logging instruments for parameters.

With the above-designed solution, the present invention can bring about the beneficial effects as follows: the present invention consists of an assembly of internal and external drill bits, power components, a pressure adjustment system for internal and external drill bits, a mud circulating system, and an unfreezing system, and the present invention employs a dual drill bit of internal and external drill bits to crush rocks by inverse rotations, which realizes the drilling with slight disturbing to the surrounding rock; the torque self-balancing of the drill bit and the power system is realized as a whole without torque effects to the upper drilling tool by utilizing the stator group and the rotor group of the power motor to drive the external and internal drill bits respectively; it is only necessary to trip the winch apparatus for the drilling tool on the ground to realize the normal operations of drilling, tripping, and logging-while-drilling by integrating the power source, the mud circulating system and the logging system, etc. into the drilling tool; the winch hoists up the drilling tool to remove the rock particles at the sticking point with alternative positive and reverse rotations of the drill bit for unfreezing in order to realize the unfreezing when got stuck. The upper drilling tool of the drilling tool system of torque self-balancing in the present invention only bears an axial force and torque balancing of the lower drilling tool is realized by opposite rotations of the internal and external drill bits, which simplifies the ground apparatus by arranging parts of the drilling rig apparatus into the borehole so as to meet the requirements of high mechanization, automation, intellectualization and simplification of drilling in the future and possess the following advantages: firstly, getting rid of deep dependence on the drill string by using the cable tube as the main transmission medium, which significantly reduces the tripping time, the cost of the drilling apparatus and tool, and the disturbing to the borehole wall from the drilling tool; secondly, strengthening the downhole real-time monitoring and controlling so that it is possible to monitor and acquire dynamic parameter changes of the downhole drilling tool in real time while drilling, which conforms more to the requirements of intellectualization and simplification; thirdly, enhancing the capacity of downhole emergency handling so that the sticking accidents can be handled in time to minimize the extent of accident damages. The present invention provides a new point of view to the whole drilling industry, and thereby possesses great innovativeness and is of significant meaning with an extremely broad prospect in application.

BRIEF DESCRIPTION OF THE DRAWINGS

The present invention is further explained with reference to the accompanying drawings and the detailed description below.

In the drawings.

Figure 1:
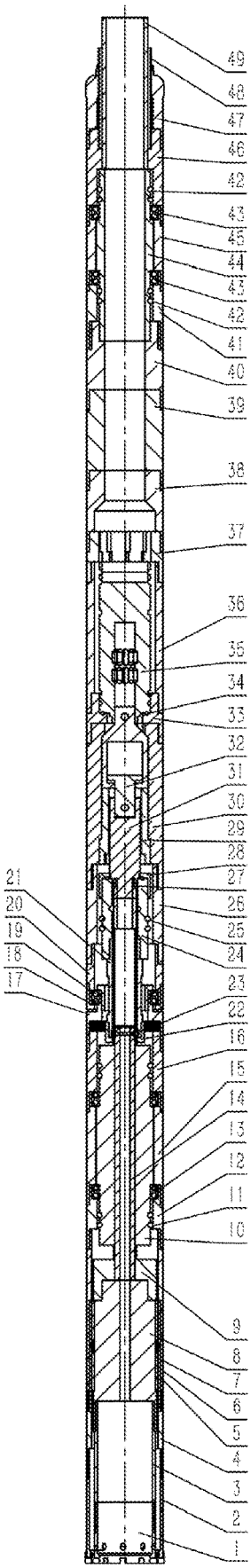
FIG. 1 is a schematic diagram of a general assembly of a downhole drilling tool system of torque self-balancing according to the present invention.

1: internal drill bit
2: external drill bit
3: core barrel
4: lower force-transfer joint of external drill bit
5: upper force-transfer joint of external drill bit
6: seal for internal and external drill bits I
7: seal for internal and external drill bits II
8: lower force-transfer joint of internal drill bit
9: upper force-transfer joint of internal drill bit
10: rotor group of power motor
11: seal ring of bearing for power system
12: lower seal for power system
13: bearing for power system
14: torque-transfer string of internal drill bit
15: stator group of power motor
16: upper seal for power system
17: pressure-transfer joint of external drill bit
18: outer anti-off sleeve for pressure-transfer mechanism of external drill bit
19: pressure-transfer and no-torque-transfer bearing for external drill bit
20: pressure-transfer string for external drill bit
21: pressure-transfer joint of internal drill bit
22: outer anti-off sleeve for pressure-transfer mechanism of internal drill bit
23: pressure-transfer and no-torque-transfer bearing for internal drill bit
24: pressure sensor for internal drill bit
25: seal ring for internal and external sensors
26: pressure sensor for external drill bit
27: power pressure-transfer seal ring for internal drill bit
28: sealing gland for pressure adjustment
29: centralizing sleeve for pressure adjustment
30: pressure adjustment housing
31: force-transfer centralizer of internal drill bit for pressure adjustment
32: pressure adjustment structure
33: lower joint of mud circulating system
34: seal ring for circulating system
35: mud circulating system
36: housing for mud circulating system
37: upper joint of mud circulating system
38: lower joint of unfreezing system
39: logging-while-drilling system
40: rotor joint of unfreezing system
41: lower seal for unfreezing system
42: seal ring for unfreezing system
43: centralizing bearing for unfreezing system
44: rotor group of unfreezing system
45: stator group of unfreezing system

46: upper seal for unfreezing system
47: drill bit for unfreezing system
48: cable with sheath
49: center tube for mud circulation
50: borehole wall

DETAILED DESCRIPTION

Figure 2:
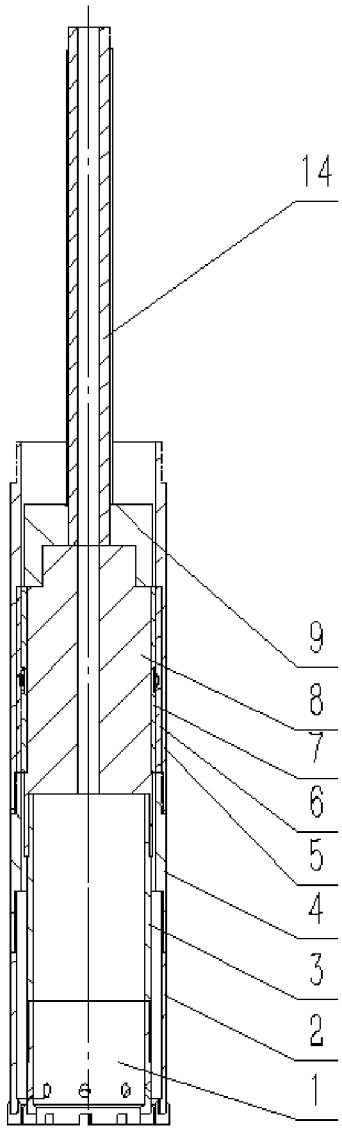
FIG. 2 is a schematic diagram of an assembly of internal and external drill bits of the downhole drilling tool system of torque self-balancing according to the present invention.
Figure 3:
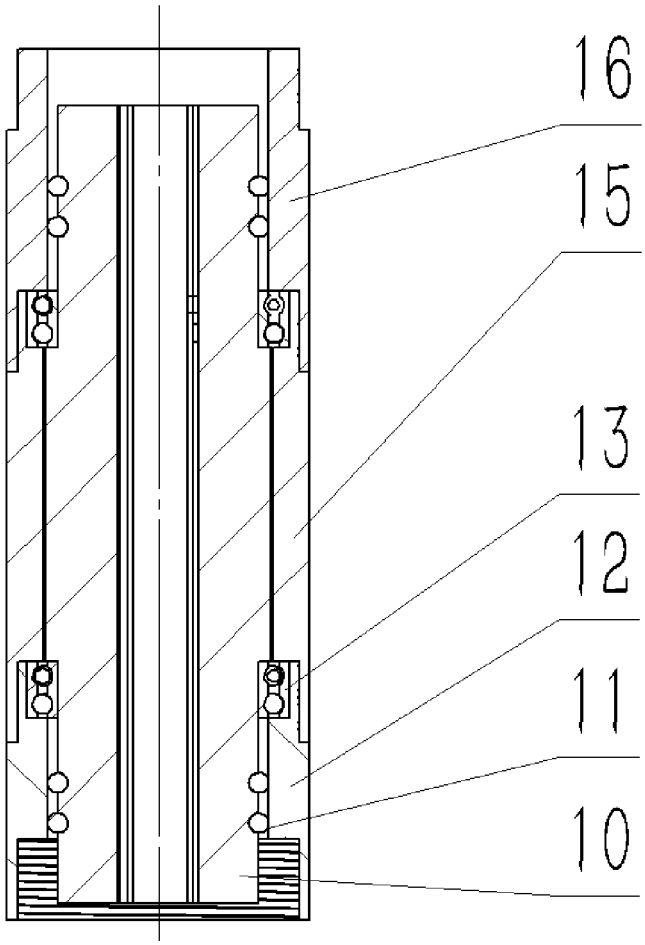
FIG. 3 is a schematic diagram of power components of the downhole drilling tool system of torque self-balancing according to the present invention.
Figure 4:
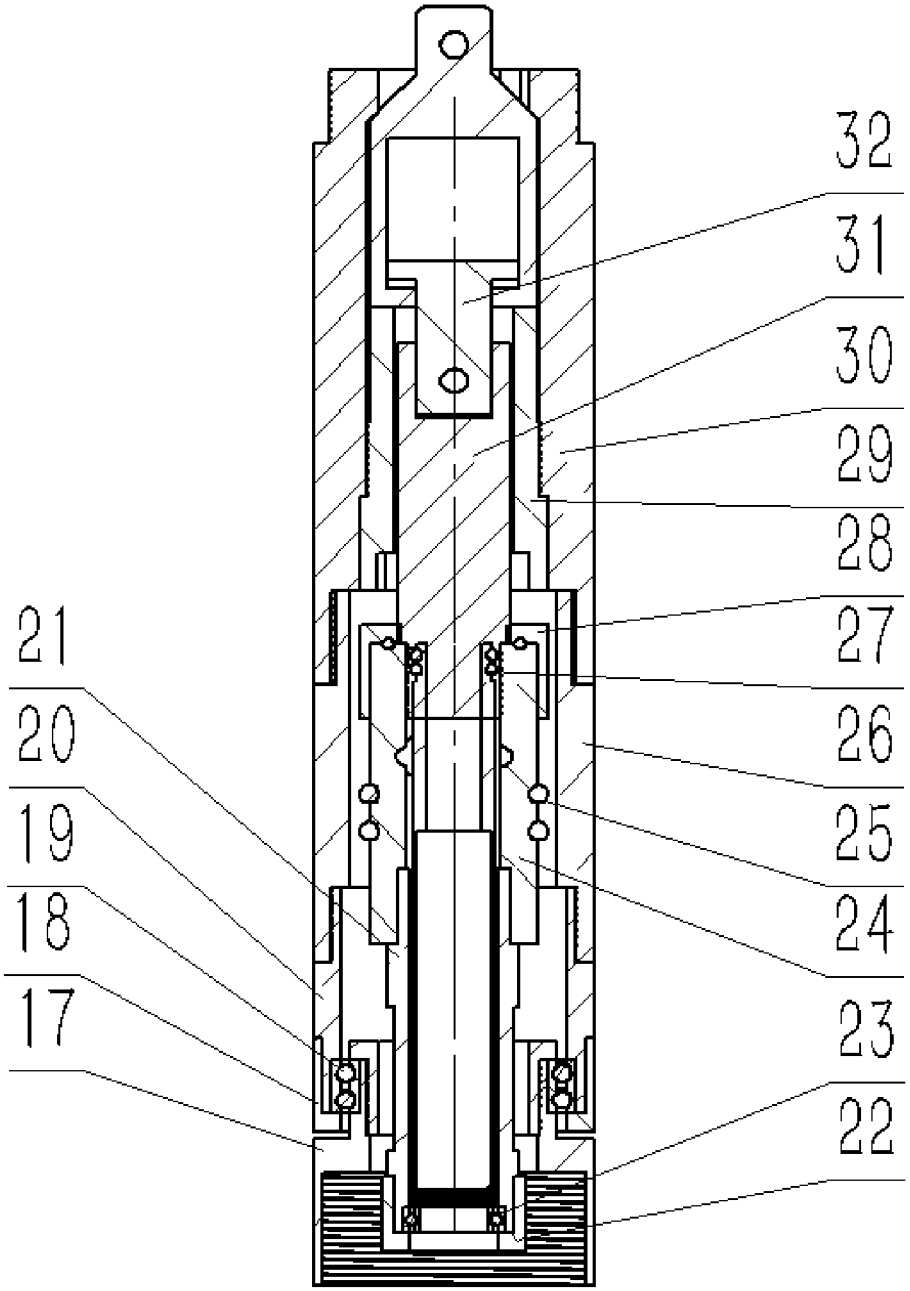
FIG. 4 is a schematic diagram of a pressure adjustment system for internal and external drill bits of the downhole drilling tool system of torque self-balancing according to the present invention.
Figure 5:
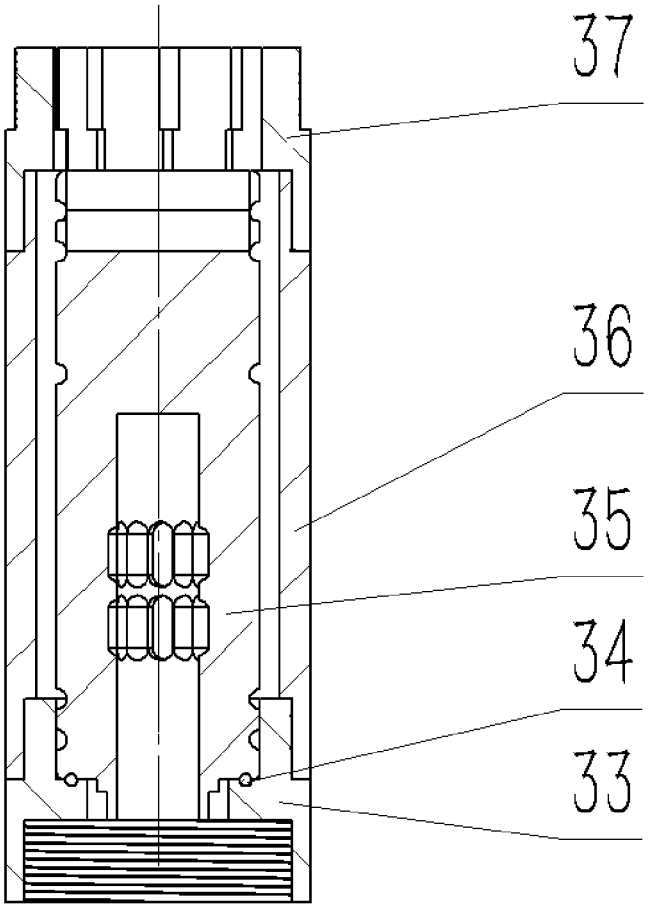
FIG. 5 is a schematic diagram of a mud circulating system of the downhole drilling tool system of torque self-balancing according to the present invention.
Figure 6:
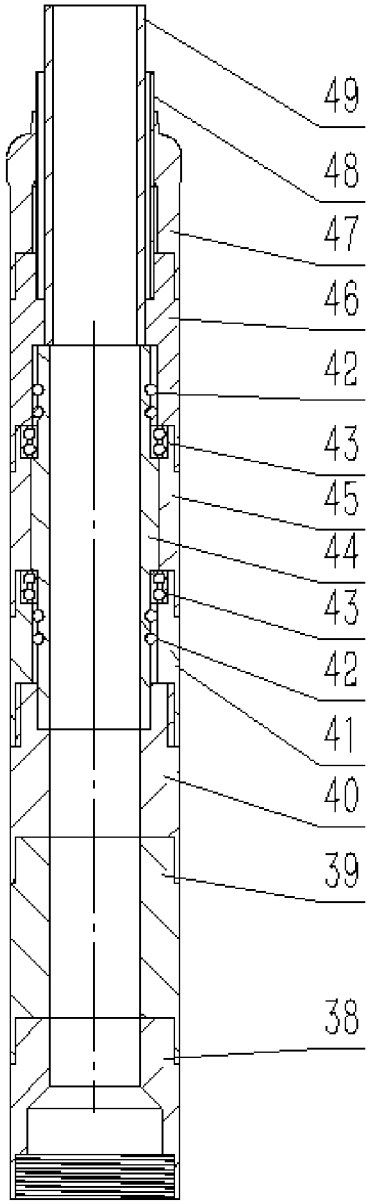
FIG. 6 is a schematic diagram of an unfreezing system of the downhole drilling tool system of torque self-balancing according to the present invention.

With reference to FIGS. 1-6, the present invention proposes a downhole drilling tool system of torque self-balancing consisting of an assembly of internal and external drill bits, power components, a pressure adjustment system for internal and external drill bits, a mud circulating system, and an unfreezing system. An upper drilling tool of the drilling tool system of torque self-balancing in the present invention only bears an axial force and torque balance of a lower drilling tool is realized by reverse rotations of the internal and external drill bits. The assembly of internal and external drill bits shown in FIG. 2 is used for cutting rocks by reverse rotations, in which the reverse torque required by the rock in contact with the drill bit from the surrounding rock is minor, thus a slight disturbing to the surrounding rock is generated and the borehole wall is still relatively regular and stable even if the drilling is performed in a crushed stratum. This assembly of internal and external drill bits comprises an internal drill bit 1, an external drill bit 2, a core barrel 3, a lower force-transfer joint of external drill bit 4, an upper force-transfer joint of external drill bit 5, a seal for internal and external drill bits I 6, a seal for internal and external drill bits II 7, a lower force-transfer joint of internal drill bit 8, an upper force-transfer joint of internal drill bit 9 and a torque-transfer string of internal drill bit 14; the internal drill bit 1, the core barrel 3, the lower force-transfer joint of internal drill bit 8, the upper force-transfer joint of internal drill bit 9 and the torque-transfer string of internal drill bit 14 are threadedly connected in sequence, and an inner diameter of the core barrel 3 is matched with an inner diameter of the internal drill bit 1; the external drill bit 2, the lower force-transfer joint of external drill bit 4 and the upper force-transfer joint of external drill bit 5 are threadedly connected; the seal for internal and external drill bits I 6 and the seal for internal and external drill bits II 7 form a pair of sliding seals for internal and external drill bits which is located between the upper force-transfer joint of external drill bit 5 and the lower force-transfer joint of internal drill bit 8 and is closely fitted with both the upper force-transfer joint of external drill bit 5 and the lower force-transfer joint of internal drill bit 8 in order to centralize and limit the internal and external drill bits. The power components shown in FIG. 3 are used for providing power to the assembly of internal and external drill bits, wherein the rotor group of power motor 10 and the stator group of power motor 15 are limited by a bearing for power system 13 through structural steps so that the rotor group of power motor 10 and the stator group of power motor 15 can rotate relatively stably; the seal ring of bearing for power system 11, the lower seal for power system 12 and the upper seal for power system 16 are combined to form a closed cavity to prevent the mud from entering into the closed cavity; an inner hole of the rotor group of power motor 10 is provided with a plurality of keyways to be connected with the torque-transfer string of internal drill bit 14 for transferring the power torque to the internal drill bit 1. A lower seal for power system 12 is threadedly connected with the upper force-transfer joint of external drill bit 5, and an upper seal for power system 16 is threadedly connected with the pressure-transfer joint of external drill bit 17. The pressure adjustment system for internal and external drill bits shown in FIG. 4 is communicatively connected with a ground data terminal via data cables for adjusting dynamically the pressure exerted on the internal and external drill bits to realize the self-balancing reverse rotations with respect to the stratum, during which both the pressure adjustment system for internal and external drill bits and the upper drilling tool are free from torques from the drill bits and only bear axial pull pressures. In the pressure adjustment assembly for internal drill bit, the pressure adjustment structure 32, the force-transfer centralizer of internal drill bit for pressure adjustment 31, the pressure sensor for internal drill bit 24, the pressure-transfer joint of internal drill bit 21 and the outer anti-off sleeve for pressure-transfer mechanism of internal drill bit 22 are threadedly connected in sequence, to transmit the drilling pressure from the upper drilling tool to the internal drill bit 1 and realize the function of pressure transfer but no torque transfer by means of the pressure-transfer and no-torque-transfer bearing for internal drill bit 23; in the pressure adjustment assembly for external drill bit, the pressure adjustment housing 30, the pressure sensor for external drill bit 26, the pressure-transfer string for external drill bit 20, the outer anti-off sleeve for pressure-transfer mechanism of external drill bit 18 and the pressure-transfer joint of external drill bit 17 are threadedly connected in sequence, to transmit the drilling pressure from the upper drilling tool to the external drill bit 2 and realize the function of pressure transfer but no torque transfer by means of the pressure-transfer and no-torque-transfer bearing for external drill bit 19; the pressure adjustment assembly for internal drill bit and the pressure adjustment assembly for external drill bit realize the function of centralizing and positioning by the centralizing sleeve for pressure adjustment 29 and realize sealing of the inner cavity of the pressure adjustment system by the seal ring for internal and external sensors 25, the power pressure-transfer seal ring for internal drill bit 27 and the sealing gland for pressure adjustment 28. The pressure-transfer joint of external drill bit 17 is threadedly connected with the upper seal for power system 16, and the pressure adjustment housing 30 is threadedly connected with the upper joint of mud circulating system 33. Instead of a ground mud pump and parts of the manifold thereof, the mud circulating system shown in FIG. 5 is used to cool the drill bits by circulating the mud, carry rock debris and protect the borehole wall 50; and the lower joint of mud circulating system 33, the housing for mud circulating system 36 and the upper joint of mud circulating system 37 are threadedly connected in sequence, wherein the lower joint of mud circulating system 33 is threadedly connected with the pressure adjustment housing 30, and the upper joint of mud circulating system 37 is threadedly connected with the lower joint of unfreezing system 38; said mud circulating system 35 is located between the lower joint of mud circulating system 33 and the upper joint of mud circulating system 37; the seal ring for circulating system 34 is disposed between the lower joint of mud circulating system 33 and the mud circulating system 35, and the seal ring for circulating system 34 obstructs the communication between the mud inlet of the upper joint of mud circulating system 37 and the lower drilling tool. The unfreezing system shown in FIG. 6 is used to handle downhole sticking accidents. The lower joint of unfreezing system 38, the logging-while-drilling system 39, the rotor joint of unfreezing system 40 and the rotor group of unfreezing system 44 are threadedly connected in sequence; the lower seal for unfreezing system 41, the stator group of unfreezing system 45, the upper seal for unfreezing system 46 and the drill bit for unfreezing system 47 are threadedly connected in sequence; the rotor joint of unfreezing system 40 is fitted with the lower seal for unfreezing system 41 with a clearance; the rotor group of unfreezing system 44 and the stator group of unfreezing system 45 realize the function of centralizing and positioning by two centralizing bearings for unfreezing system 43 and realize sealing of the inner cavity of the unfreezing power system by two groups of seal rings for unfreezing system 42. Various instruments such as sensors for measuring parameters, etc. can be mounted in the logging-while-drilling system 39 in an environment of no torque in the upper portion, and various logging instruments such as of sound, electricity, magnetism and radioactivity and the like are reserved in said logging-while-drilling system 39 and the logging-while-drilling system 39 transmits the collected and related data to the ground data terminal via data cables for processing. The cable with sheath 48 and the center tube for mud circulation 49 are threadedly and hermetically connected with the upper seal for unfreezing system 46 respectively, and the lower joint of unfreezing system 38 is threadedly connected with upper joint of mud circulating system 37. The lengths of the cable with sheath 48 and the center tube for mud circulation 49 lengthen with the drilling, and the cable with sheath 48 is armored for protection with a higher tensile strength.

The working principle and process of the present invention:

Rock crushing by rotations of the internal and external drill bits: the rotor group of power motor 10 drives the upper force-transfer joint of internal drill bit 9, the lower force-transfer joint of internal drill bit 8 and the core barrel 3 by the torque-transfer string of internal drill bit 14 via keyways and finally the power torque is transmitted to the internal drill bit 1, leading to rock crushing by the rotation of the internal drill bit; and at the same time the stator group of power motor 15, the lower seal for power system 12, the upper force-transfer joint of external drill bit 5 and the lower force-transfer joint of external drill bit 4 are threadedly connected in sequence, and the reverse power torque generated by the rock crushing of the internal drill bit is transmitted to the external drill bit 2, leading to rock crushing by the reverse rotation of the external drill bit.

Automatic adjustment for drilling pressure of the internal and external drill bits: the pressure adjustment system for internal and external drill bits is communicatively connected with a ground data terminal via data cables, the pressure adjustment system for internal and external drill bits is controlled automatically by an electrical control system, the drilling tool is pressed by its own weight in the present drilling tool system, and the hoisting-up and hoisting-down of the cable with sheath 48 is controlled by hoisting up and down of the drilling tool by means of a winch and a total drilling pressure exerted on the internal and external drill bits is adjusted by the hoisting-up and hoisting-down of the cable with sheath 48. The total drilling pressure is transmitted to the pressure adjustment structure 32 and the pressure adjustment housing 30 via the motor drive of the pressure adjustment structure 32 respectively, and the ratio of the drilling pressure exerted on the internal and external drill bits is adjusted automatically by an electrical control program which is performed mainly on the basis of the drilling pressure data acquired by the pressure sensor for internal drill bit 24 and the pressure sensor for external drill bit 26.

Figure 7:
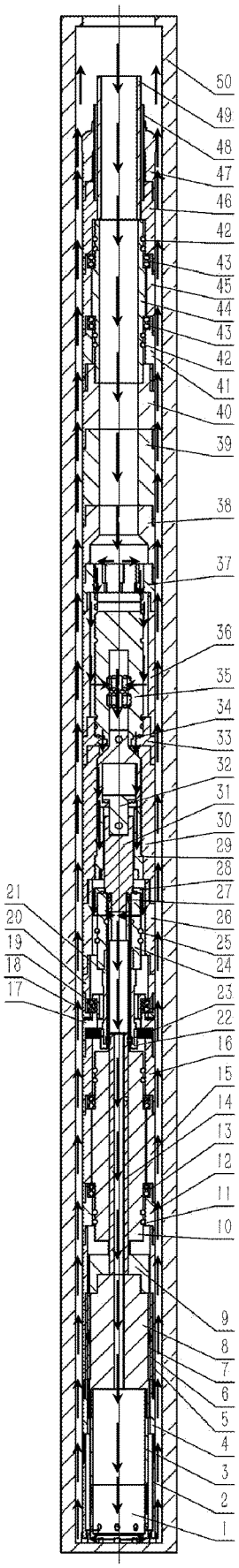
FIG. 7 is a schematic diagram of a positive mud circulation of the downhole drilling tool system of torque self-balancing according to the present invention.
Figure 8:
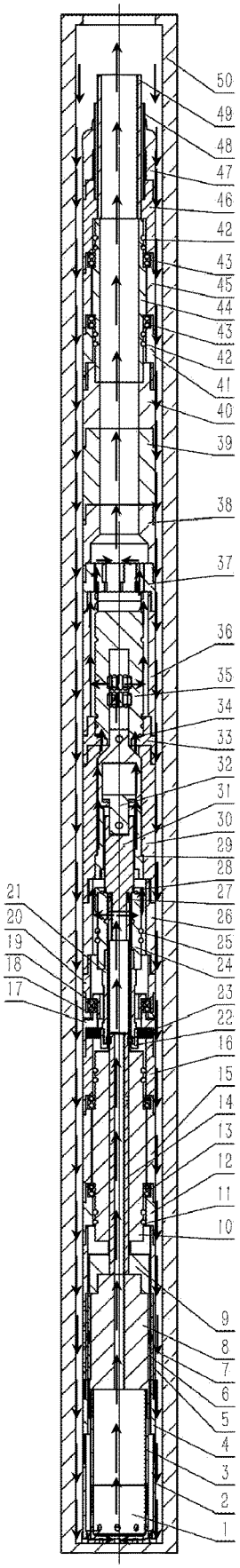
FIG. 8 is a schematic diagram of a reverse mud circulation of the downhole drilling tool system of torque self-balancing according to the present invention.

The principle of the drilling pressure transfer without torque in the upper drilling tool: the drilling pressure exerted on the lower drill bit by the upper drilling tool is transmitted to the pressure-transfer joint of internal drill bit 21 and the pressure-transfer joint of external drill bit 17 via the pressure-transfer and no-torque-transfer bearing for internal drill bit 23 and the pressure-transfer and no-torque-transfer bearing for external drill bit 19 respectively, leading to transmission of the drilling pressure from the upper stationary drilling tool to the lower rotational drilling tool. Said mud circulating system has two kinds of circulations, namely a positive circulation and a reverse circulation. The mud circulation is shown in FIG. 7 and FIG. 8: when drilling is performed with the positive circulation, the mud circulating system 35 delivers the ground mud to the cutting teeth of both the internal drill bit 1 and the external drill bit 2 through the center tube for mud circulation 49, the center of the rotor group of unfreezing system 44, the center of the rotor joint of unfreezing system 40, the center of the logging-while-drilling system 39, the center of the lower joint of unfreezing system 38, the center of the upper joint of mud circulating system 37, the mud passage in the pressure adjustment system for internal and external drill bits and the center of the torque-transfer string of internal drill bit 14, then brings the heat and rock debris upward and back into a ground mud sump via an annular space between an outer wall of the drilling tool system and the borehole wall 50, realizing the positive circulation of the mud; and when drilling is performed with the reverse circulation, the mud circulating system 35 delivers the ground mud to the cutting teeth of both the internal drill bit 1 and the external drill bit 2 via the annular space between the outer wall of the drilling tool system and the borehole wall 50, then brings the heat and rock debris upward and back into the ground mud sump along the way of the mud passage in the pressure adjustment system for internal and external drill bits, the center of the torque-transfer string of internal drill bit 14, the center of the upper joint of mud circulating system 37, the center of the lower joint of unfreezing system 38, the center of the logging-while-drilling system 39, the center of the rotor joint of unfreezing system 40, the center of the rotor group of unfreezing system 44 and the center tube for mud circulation 49, realizing the reverse circulation of the mud.

The working principle and process of the unfreezing system: when the drilling tool system gets stuck within the borehole and the traction force for hoisting-up of the drilling tool exceeds a set value, the power motor of the unfreezing system is activated by the system automatically, and the stator group of unfreezing system 45 of the motor drives the drill bit for unfreezing system 47 to perform alternative positive and reverse rotations in order to cut the obstacles at the upper sticking point, this action will not stop until the traction force for hoisting-up is lower than the set value, and then the hoisting-up, hoisting-down or drilling will continue.

The invention claimed is:

1. A downhole drilling tool system of torque self-balancing, characterized in that the drilling tool system consists of an assembly of internal and external drill bits, power components, a pressure adjustment system for internal and external drill bits, a mud circulating system, and an unfreezing system, wherein the assembly of internal and external drill bits comprises an internal drill bit, an external drill bit, a core barrel, a lower force-transfer joint of external drill bit, an upper force-transfer joint of external drill bit, a first seal for the internal and external drill bits, and a second seal for the internal and external drill bits, a lower force-transfer joint of internal drill bit, an upper force-transfer joint of internal drill bit and a torque-transfer string of internal drill bit; the internal drill bit, the core barrel, the lower force-transfer joint of internal drill bit, the upper force-transfer joint of internal drill bit and the torque-transfer string of internal drill bit are threadedly connected in sequence, and an inner diameter of the core barrel is matched with an inner diameter of the internal drill bit; the external drill bit, the lower force-transfer joint of external drill bit and the upper force-transfer joint of external drill bit are threadedly connected in sequence; the seal for internal and external drill bits I and the seal for internal and external drill bits II form a pair of sliding seals for internal and external drill bits which is located between the upper force-transfer joint of external drill bit and the lower force-transfer joint of internal drill bit and is fitted closely and slidably with both the upper force-transfer joint of external drill bit and the lower force-transfer joint of internal drill bit;

wherein the power components comprise a rotor group of power motor, a seal ring of bearing for power system, a lower seal for power system, a bearing for power system, a stator group of power motor and an upper seal for power system; the rotor group of power motor and the stator group of power motor are connected with the bearing for power system respectively, wherein an inner hole of the rotor group of power motor is provided with keyways via which the rotor group of power motor is connected with the torque-transfer string of internal drill bit; the stator group of power motor, the lower seal for power system, the upper force-transfer joint of external drill bit and the lower force-transfer joint of external drill bit are threadedly connected in sequence; the lower seal for power system is threadedly connected with the upper force-transfer joint of external drill bit, and the lower seal for power system cooperates with the seal ring of bearing for power system to form a lower closed cavity; the upper seal for power system is threadedly connected with a pressure-transfer joint of external drill bit, and the upper seal for power system cooperates with the seal ring of bearing for power system to form an upper closed cavity;

wherein the pressure adjustment system for internal and external drill bits is communicatively connected with a data terminal on the ground via data cables, the pressure adjustment system for internal and external drill bits comprises two assemblies of a pressure adjustment assembly for internal drill bit and a pressure adjustment assembly for external drill bit, wherein the pressure adjustment assembly for internal drill bit and the pressure adjustment assembly for external drill bit are threadedly connected by a centralizing sleeve for pressure adjustment; the pressure adjustment assembly for internal drill bit consists of a pressure-transfer joint of internal drill bit, an outer anti-off sleeve for pressure-transfer mechanism of internal drill bit, a pressure-transfer and no-torque-transfer bearing for internal drill bit, a pressure sensor for internal drill bit, a force-transfer centralizer of internal drill bit for pressure adjustment and a pressure adjustment structure; the pressure adjustment structure, the force-transfer centralizer of internal drill bit for pressure adjustment, the pressure sensor for internal drill bit, the pressure-transfer joint of internal drill bit and the outer anti-off sleeve for pressure-transfer mechanism of internal drill bit are threadedly connected in sequence from top to down; an inner ring of the pressure-transfer and no-torque-transfer bearing for internal drill bit is connected with the pressure-transfer joint of internal drill bit, and an outer ring of the pressure-transfer and no-torque-transfer bearing for internal drill bit is connected with the outer anti-off sleeve for pressure-transfer mechanism of internal drill bit; the pressure adjustment assembly for external drill bit consists of a pressure-transfer joint of external drill bit, an outer anti-off sleeve for pressure-transfer mechanism of external drill bit, a pressure-transfer and no-torque-transfer bearing for external drill bit, a pressure-transfer string for external drill bit, a pressure sensor for external drill bit and a pressure adjustment housing; the pressure adjustment housing, the pressure sensor for external drill bit, the pressure-transfer string for external drill bit, the outer anti-off sleeve for pressure-transfer mechanism of external drill bit and the pressure-transfer joint of external drill bit are threadedly connected in sequence from top to down, wherein the pressure adjustment housing is threadedly connected with an upper joint of mud circulating system; an inner ring of the pressure-transfer and no-torque-transfer bearing for external drill bit is connected with the pressure-transfer joint of external drill bit, and an outer ring of the pressure-transfer and no-torque-transfer bearing for external drill bit is connected with the pressure-transfer string for external drill bit; the seal ring for internal and external sensors is disposed between the pressure sensor for internal drill bit and the pressure sensor for external drill bit; the power pressure-transfer seal ring for internal drill bit is located between a force-transfer centralizer of internal drill bit for adjustment and the pressure sensor for internal drill bit; a sealing gland for pressure adjustment is situated between the pressure adjustment housing and the pressure sensor for external drill bit;

wherein the mud circulating system comprises a lower joint of mud circulating system, a mud circulating system, a housing for mud circulating system and an upper joint of mud circulating system; the lower joint of mud circulating system, the housing for mud circulating system and the upper joint of mud circulating system are threadedly connected in sequence, wherein the lower joint of mud circulating system is threadedly connected with the pressure adjustment housing, and the upper joint of mud circulating system is threadedly connected with a lower joint of unfreezing system; the mud circulating system is situated between the lower joint of mud circulating system and the upper joint of mud circulating system; the seal ring for circulating system is disposed between the lower joint of mud circulating system and the mud circulating system;

wherein the unfreezing system comprises a lower joint of unfreezing system, a logging-while-drilling system, a rotor joint of unfreezing system, a lower seal for unfreezing system, seal rings for unfreezing system, a centralizing bearing for unfreezing system, a rotor group of unfreezing system, a stator group of unfreezing system, an upper seal for unfreezing system, a drill bit for unfreezing system, a cable with sheath and a center tube for mud circulation; the lower joint of unfreezing system, the logging-while-drilling system, the rotor joint of unfreezing system and the rotor group of unfreezing system are threadedly connected in sequence; the lower seal for unfreezing system, the stator group of unfreezing system, the upper seal for unfreezing system and the drill bit for unfreezing system are threadedly connected in sequence; the rotor joint of unfreezing system is fitted with the lower seal for unfreezing system with a clearance; the rotor group of unfreezing system and the stator group of unfreezing system are connected with the centralizing bearing for unfreezing system respectively; a seal ring for unfreezing system is arranged between the rotor group of unfreezing system and the lower seal for unfreezing system, and a seal ring for unfreezing system is arranged between rotor group of unfreezing system and the upper seal for unfreezing system; the cable with sheath and the center tube for mud circulation are in a sealed and threaded connection with the upper seal for unfreezing system, respectively.

2. The downhole drilling tool system of torque self-balancing according to claim 1, characterized in that the logging-while-drilling system is provided with logging instruments for parameters.

* * * * *